US006322897B1

(12) United States Patent
Borchert et al.

(10) Patent No.: US 6,322,897 B1
(45) Date of Patent: Nov. 27, 2001

(54) METAL-CERAMIC GRADIENT MATERIAL, PRODUCT MADE FROM A METAL-CERAMIC GRADIENT MATERIAL AND PROCESS FOR PRODUCING A METAL-CERAMIC GRADIENT MATERIAL

(75) Inventors: Ralph Borchert, Dortmund; Monika Willert-Porada, Bayreuth, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/450,400

(22) Filed: Nov. 29, 1999

Related U.S. Application Data

(63) Continuation of application No. PCT/DE98/01465, filed on May 28, 1998.

(30) Foreign Application Priority Data

May 28, 1997 (DE) ..... 197 22 390

(51) Int. Cl.[7] ..... B32B 15/04

(52) U.S. Cl. ..... 428/469; 428/472; 428/633; 428/701; 428/702; 501/1; 501/103; 501/134

(58) Field of Search ..... 428/610, 632, 428/633, 469, 472, 701, 702; 501/134, 1, 103

(56) References Cited

U.S. PATENT DOCUMENTS

| | | | | |
|---|---|---|---|---|
| 4,321,311 | | 3/1982 | Strangmann . | |
| 4,751,099 | * | 6/1988 | Nino et al. | 427/34 |
| 5,320,909 | * | 6/1994 | Scharman et al. | 428/472 |
| 5,834,070 | * | 11/1998 | Movchan et al. | 427/566 |
| 5,912,087 | * | 6/1999 | Jackson et al. | 428/610 |

FOREIGN PATENT DOCUMENTS 0 229 522 A2 7/1987 (EP) .

0 635 580 A1 1/1995 (EP) .

OTHER PUBLICATIONS

Woo Y. Lee et al.: "Concept of Functionally Graded Materials for Advanced Thermal Barrier Coating Applications", J. Am. Ceram. Soc. 79 (12) pp. 3003–3012 (1996).

"FGM components: PM meets the challenge", MPR Dec. 1996, pp. 28–32.

International Patent Application WO 85/05352 (Svensson et al.), dated Dec. 5, 1985.

W. Henning et al.: "Keramische Gradientenwerkstoffe für Komponenten in Verbrennungsmotoren", Metall, No. 5, 1992, pp. 436–439, ceramic gradient materials as components in internal combustion engines.

N. Niino et al.: "Projected research on high–efficiency energy conversion materials", FGM 94, 1994, pp. 601–605.

N. Cerradi et al.: "Matériaux à gradient: exploitation du concept et techniques de production par métallurgie des poudres", La Revue de Mëtallurgie–CIT/Science et Gënie des Matëriaux, Feb. 1996, pp. 185–195, gradient materials: researching the concept and production techniques with metallic powder.

* cited by examiner

*Primary Examiner*—Deborah Jones
*Assistant Examiner*—Bryant Young
(74) *Attorney, Agent, or Firm*—Herbert L. Lerner; Laurence A. Greenberg; Werner H. Stemer

(57) ABSTRACT

A metal-ceramic gradient material, in particular for a thermal shield or a gas turbine blade, includes a metal base material, a ceramic and an additive for high-temperature oxidation protection. The metal base material has a concentration decreasing from a metal-rich zone into a ceramic-rich zone. The additive has a concentration with a concentration gradient. The concentration of the additive has a maximum. A product made from a metal-ceramic gradient material and a process for producing a metal-ceramic gradient material are also provided.

18 Claims, 14 Drawing Sheets

METAL-CERAMIC GRADIENT MATERIAL, PRODUCT MADE FROM A METAL-CERAMIC GRADIENT MATERIAL AND PROCESS FOR PRODUCING A METAL-CERAMIC GRADIENT MATERIAL

CROSS-REFERENCE TO RELATED APPLICATION

This application is a continuation of copending International Application No. PCT/DE98/01465, filed May 28, 1998, which designated the United States.

BACKGROUND OF THE INVENTION

FIELD OF THE INVENTION

The invention relates to a metal-ceramic gradient material, a product made from a metal-ceramic gradient material, in particular a thermal shield or a gas turbine blade, and a process for producing a metal-ceramic gradient material.

In order to provide heat-resistance for a component which is exposed to extremely high temperatures, for example a thermal shield or a gas turbine blade, it is known, for example from U.S. Pat. No. 4,321,311, to produce the component from a metal base body and to coat the metal base body with a ceramic thermal barrier layer of $ZrO_2$. The ceramic thermal carrier layer is bonded-on through a metallic adhesion promoter layer formed of an alloy of the type MCrAlY. Since the ceramic thermal barrier layer is generally a good conductor of oxygen ions, the adhesion promoter layer becomes oxidized during the course of operational use of the component. As a result, the thermal barrier layer can become detached from the metal base body. That results in the duration of use of a component of that kind being limited. That is the case in particular in the event of frequent temperature changes, which occur when a gas turbine is started up and run down.

An article entitled "Keramische Gradientenwerkstoffe fur Komponenten in Verbrennungsmotoren" [Ceramic Gradient Materials for Components in Internal Combustion Engines] by W. Henning et al. in Metall, Vol. 46, Issue 5, May 1992, pp. 436–439, discusses a fiber ceramic body with a density gradient for the purpose of improving the resistance of piston heads to temperature changes. That fiber ceramic body is composed of four layers of different layer thicknesses and different ceramic fractions. The difference in the ceramic fraction resides in the fact that the ratio of fibers (short $Al_2O_3$ fibers) to ceramic particles of $Al_2TiO_5$ differs distinctly in the four layers. As a result, the porosity of the four layers also differs considerably with respect to one another. The high porosity of the layers, lying between 40% and 79%, is used to introduce molten metal into the cavities in the fiber ceramic body through the use of squeeze casting, so as to produce a defect-free composite. As a result, it is possible to produce a piston head which has a gradient of metal and ceramic that changes considerably and suddenly. Due to the low thermal conductivity of the ceramic fractions, a thermal barrier is formed, so that the piston is insulated. In addition, the fiber ceramic reinforces the piston and therefore improves the resistance of the piston to thermal shocks.

An article entitled "Projected Research on High Efficiency Energy Conversion Materials", by M. Niino and M. Koizumi in FGM 94, Proc. of the 3$^{rd}$ Int. Symposium on Functional Gradient Materials, ed. B. Ilschner and N. Cherradi, pp. 601–605, 1994, has described composite materials, in connection with the development of materials for a space shuttle, which are referred to as Functional Gradient Material (FGM). The essential feature of FGM is a continuous composition gradient and/or microstructure gradient, which is intended to lead to a continuous gradient of the relevant functions, e.g. the strength, thermal conductivity, ductility, inter alia.

The intention is to increase the load-bearing capacity and efficiency of the material by avoiding abrupt changes in properties. FGMs are therefore intended to combine the positive properties of laminated composites and lump composites in a single material.

SUMMARY OF THE INVENTION

It is accordingly an object of the invention to provide a metal-ceramic gradient material for use at high temperatures over a long period of time, a product for a high operating temperature made from a metal-ceramic gradient material and a process for producing a metal-ceramic gradient material, which overcome the hereinafore-mentioned disadvantages of the heretofore-known materials, products and processes of this is general type.

With the foregoing and other objects in view there is provided, in accordance with the invention, a metal-ceramic gradient material, in particular for a thermal shield or a gas turbine blade, comprising a metal base material; a ceramic; a metal-rich zone, a ceramic-rich zone; an additive for high-temperature oxidation protection; the metal base material having a concentration decreasing from the metal-rich zone into the ceramic-rich zone; the additive having a concentration with a concentration gradient; and the concentration of the additive having a maximum.

With the objects of the invention in view, there is also provided a product, in particular a gas turbine blade or a heat-protection element of a gas turbine, comprising a gradient material including a metal base material; a ceramic; a metal-rich zone; a ceramic-rich zone; an additive for high-temperature oxidation protection; the metal base material having a concentration decreasing from the metal-rich zone into the ceramic-rich zone; the additive having a concentration with a concentration gradient; and the concentration of the additive having a maximum.

With the objects of the invention in view, there is additionally provided a process for producing a gradient material, which comprises pouring powders having different mixtures of at least one of a metal base material, a ceramic and an additive for high-temperature oxidation protection over one another to form a packed bed; and then compacting and sintering the packed bed to form a gradient material; the metal base material having a concentration decreasing from a metal-rich zone into a ceramic-rich zone, the additive having a concentration with a concentration gradient, and the concentration of the additive having a maximum.

In accordance with another feature of the invention, the concentration gradient of the additive has an essentially continuous maximum. In accordance with a further feature of the invention, the concentration gradient of the additive extends from the ceramic-rich zone as far as into the metal-rich zone.

In accordance with an added feature of the invention, there is provided a metal-free zone, the maximum lying between the metal-free zone and the ceramic-rich zone.

In accordance with an additional feature of the invention, the concentration of the additive increases from approximately 5% by volume in the metal-rich zone to approximately 30% by volume and falls to approximately 5% by volume in the ceramic-rich zone.

In accordance with yet another feature of the invention, the concentration of the additive has a plurality of maximums.

In accordance with yet a further feature of the invention, the additive has a bimodal grain size distribution, in particular a fine-grain fraction with grain diameters of less than 10 $\mu$m and a coarse-grain fraction with grain diameters of greater than 100 $\mu$m.

In accordance with yet an added feature of the invention, the additive forms pores, in particular with a diameter of between 0.1 $\mu$m and 5 $\mu$m and preferably between 1.0 $\mu$m and 2.0 $\mu$m.

In accordance with yet an additional feature of the invention, the metal base material is a nickel-chromium alloy and the ceramic includes zirconium oxide.

In accordance with a concomitant feature of the invention, the additive includes zirconium silicate.

The invention is based on the concept of refining a Functional Gradient Material (FGM) with regard to the oxidation-resistance function. In the case of a ceramic-metallic FGM, the gradient of the composition may extend over the function-performing cross-section of a component from 100% ceramic to 100% metal, although it is also possible to use gradients of other limit concentrations, or "partial gradients", for certain purposes. Furthermore, in addition to a continuous gradient, for certain components symmetrical gradients are also possible, e.g. ceramic-metal-ceramic or combinations of the composition gradients.

An FGM can also be regarded as a link between conventional layer systems and typical ceramic-matrix systems with 2D or 3D reinforcing elements. In that case, in the microstructure between the pure ceramic and metal components, there is a transition from the dispersion material with a ceramic matrix, through interpenetrating networks of ceramic and metal, to a dispersion material with a metal matrix. In special cases, the use of further material classes, e.g. organic polymers or amorphous materials, such as oxidic and non-oxidic glass materials, is possible in order to achieve particular combinations of properties. In addition, the profile of properties can be modified by introducing a plurality of ceramic or metal materials. The range of possibilities extends, in the case of ceramics, from oxides, through nitrides and carbides, to silicates and phosphates. Suitable metals are Fe-base, Ni-base, Al-base and Ti-base alloys and intermetallic phases. Ceramic-metal FGMs which are formed, for example, of 8Y—$ZrO_2$—NiCr8020 may be advantageous as thermal barrier systems, since the composition gradient is suitable for minimizing thermomechanical stresses and thus for increasing the thickness of the thermal barrier layer. However, a decisive criterion for the use of such FGMs for heat insulation is the oxidation resistance which, due to the particular microstructure, cannot be ensured with the aid of metal interlayers. This is because, with regard to thermal barrier layer systems, a gradient of the composition results in a ceramic-metal interface which is spatially "blurred" and has an increased size in comparison with a laminated composite. The oxidation-inhibiting interlayer (e.g. NiCrAlY) which has heretofore been used in laminated composites is therefore not compatible with the concept of an FGM. Accordingly, FGMs which are based on 8Y—$ZrO_2$ are not sufficiently oxidation-resistant as thermal barrier layer systems (TBL). In addition, it may be necessary, in order to improve the corrosion-resistance and high-temperature resistance of an FGM in comparison with the traditional laminated composite, for the ceramic-rich zones of an FGM to have a higher density than plasma-sprayed TBL. That results in the 8Y—$ZrO_2$ having a high conductivity with regard to oxygen ions, a high thermal conductivity and a low resistance to temperature changes.

The invention therefore envisages the use of an additive for high-temperature oxidation protection with a concentration gradient. As a result, for the use of an FGM as a thermal barrier material, depending on requirements, a particular microstructure can be set in the region of the ceramic. Therefore, a good thermal insulation level and resistance to temperature changes, as well as stability against shrinkage caused by resintering, is achieved while keeping the porosity as low as possible.

In comparison with conventional thermal barrier systems, the metal-ceramic gradient material does not include a layer system but rather a penetration structure, in which the ceramic phase merges, in an interpenetrating manner, into the metallic base material through an additive (in this case preferably: $ZrSiO_4$). This additive not only dramatically reduces the oxygen diffusion, but also preferably at the same time ensures that thermodynamically stable oxides and silicates cover the metallic surface. The additive preferably exhibits low thermal expansion and good adhesion both with regard to the ceramic and with regard to the metal. It is preferably thermally stable and preferably does not form any low-melting eutectics with the ceramic, in particular a $ZrO_2$ layer, or with the metal or the corrosion products thereof. The result is an improvement in the long-term oxidation resistance by comparison with conventional layer systems including a metallic base material, a metal adhesion layer and a ceramic, and in addition flaking-off is avoided.

Preferably, the additive forms a stable network of highly branched microcracks and closed porosity. The result is a low modulus of elasticity of the ceramic-rich areas and a reduction in the thermal conductivity. Both effects are desirable for use at high temperatures, since they have a direct influence on the resistance to temperature changes and the heat-insulation properties of the system. The result is both an improvement to the oxidation stability as well as to the system stability, even in combination with improved thermal barrier properties. When used in a product which is exposed to hot gas, e.g. a gas turbine, this has a direct effect on the availability (reliability) and the possible turbine inlet temperatures, i.e. on the consumption of cooling air and increasing the efficiency.

Preferably, the metallic base material is a chromium-nickel alloy, e.g. NiCr020, and the ceramic includes zirconium oxide which may, for example, be partially stabilized with yttrium (8Y—$ZrO_2$). Due to the addition of an additive to the volume of the FGM, this FGM (e.g. 8Y—$ZrO_2$—NiCr8020-FGM) has little tendency to oxidize even at high temperatures of up to over 1000° C. Due to a combination of thermomechanical and chemical measures, this additive enables the FGM to have a high stability to oxidation. The chemical action is to be understood as a reduction in the oxygen-ion conductivity of the ceramic, in particular 8Y—$ZrO_2$, and a high dissolution capacity with regard to Cr oxide and other non-ferrous oxides which result from the oxidation of the metals. Preferably, the additive has good wetting and adhesion properties both with regard to metals and also with regard to the ceramic, in particular $ZrO_2$. Preferably, therefore, the additive covers the grain boundaries of the ceramic, in particular the 8Y—$ZrO_2$, with precipitations, e.g. of $SiO_2$. Such precipitations of, for example, $SiO_2$or other substances with compound anions at the grain boundaries of the ceramic, e.g. of 8Y—$ZrO_2$, considerably impair the conductivity of the ceramic with regard to oxygen ions. A reduction in the oxygen conductivity of the ceramic is preferably achieved even at high temperatures of above 800° C. The metal oxidation can also be slowed down if the additive prevents the evaporation of the oxides being produced and a substoichiometric level of oxygen, which could lead to the formation of volatile suboxides. For this purpose too, it is recommended to use a silicate (or phosphate, stannate, titanate) which, by dissolving the oxides being produced, prevents them from evaporating and ensures that the metal surface is properly covered with thermodynamically stable oxides and silicates.

From the point of view of the thermomechanical properties, it is preferred to provide an additive which allows the controlled introduction of highly branched microcracks and/or the formation of metastable, closed pores. On one hand, these reduce the modulus of elasticity of the ceramic-rich zones of the FGM and, on the other hand, they absorb the local tensile stresses around the metal grains in the metal-containing zones of the FGM. The porosity and the network of is cracks additionally impair the thermal conductivity.

The use of unstabilized $ZrO_2$ as a microcrack initiator is effective due to the t→m transformation, e.g. in tightly sintered ceramic materials. In this case, the additive is itself preferably ceramic and has a very low linear thermal expansion and/or a considerable anisotropy of the thermal expansion. Due to its high levels of adhesion both with respect to the actual ceramic, e.g. the 8Y—$ZrO_2$, and with regard to the metal, the additive is able to absorb tensile stresses between these two constituents of an FGM and to reduce these stresses by the formation of microcracks. The density and extent of the network of cracks can be affected through the use of the particle size and the proportion by volume of the additive. In addition, the additive is thermally stable and preferably does not form any extremely low-melting eutectics with the oxidation products or the constituents of the FGM.

$ZrSiO_4$ is preferably suitable as the additive. Further possible additives are mullite, zirconyl phosphates or Al phosphates, and glass ceramics. Through the use of such an additive, it is possible to exploit the advantages of the FGM with regard to an increase in the thickness of the TBL. Therefore, oxidation protection is achieved at the metal-ceramic interface in the dimensions of the microstructure constituents, i.e. the metal-ceramic agglomerates and grains, and that protection additionally exhibits the required microstructural features.

Preferably, the metal-ceramic gradient material is used to produce a product which is exposed to a hot, possibly aggressive gas, such as a component of a gas turbine, a furnace or the like. Thus it is possible to use gradient systems, in particular those containing $ZrSiO_4$, as materials for thermal protection systems in the hot-gas path of gas turbines. These may preferably be thermal shields having a simple geometry. In addition to this, use as thermal protection systems is possible in all sectors in which use at high temperatures in the presence of oxidizing gases is required.

Other features which are considered as characteristic for the invention are set forth in the appended claims.

Although the invention is illustrated and described herein as embodied in a metal-ceramic gradient material, a product made from a metal-ceramic gradient material and a process for producing a metal-ceramic gradient material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Referring now to the figures of the drawings as a whole, a description will be given of the production of powder preforms, sintering and physical tests which are carried out.

Figure 1A:
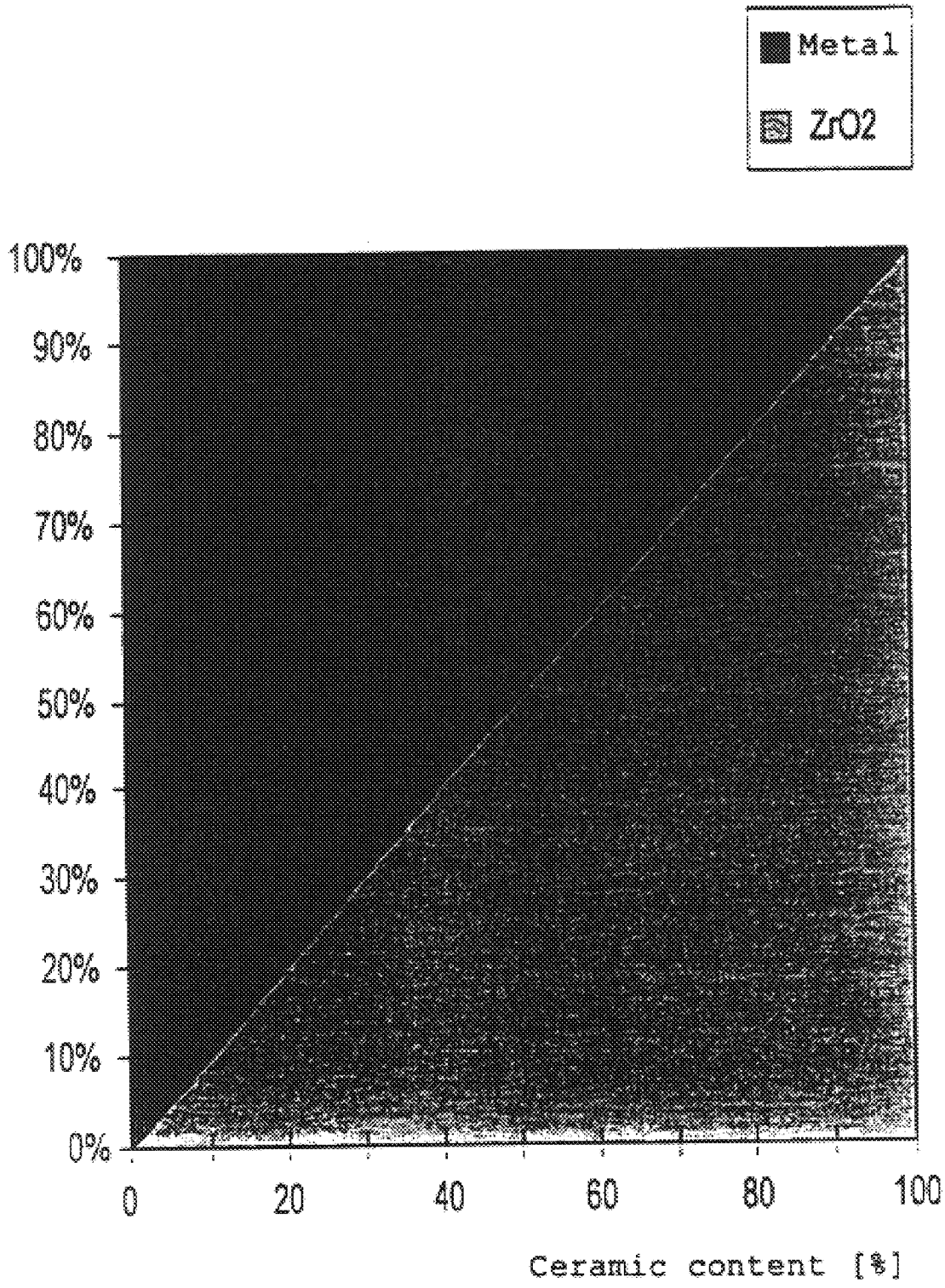
FIG. 1*a* is a photograph showing a linear gradient of a composition for a thermal barrier FGM material.
Figure 1B:
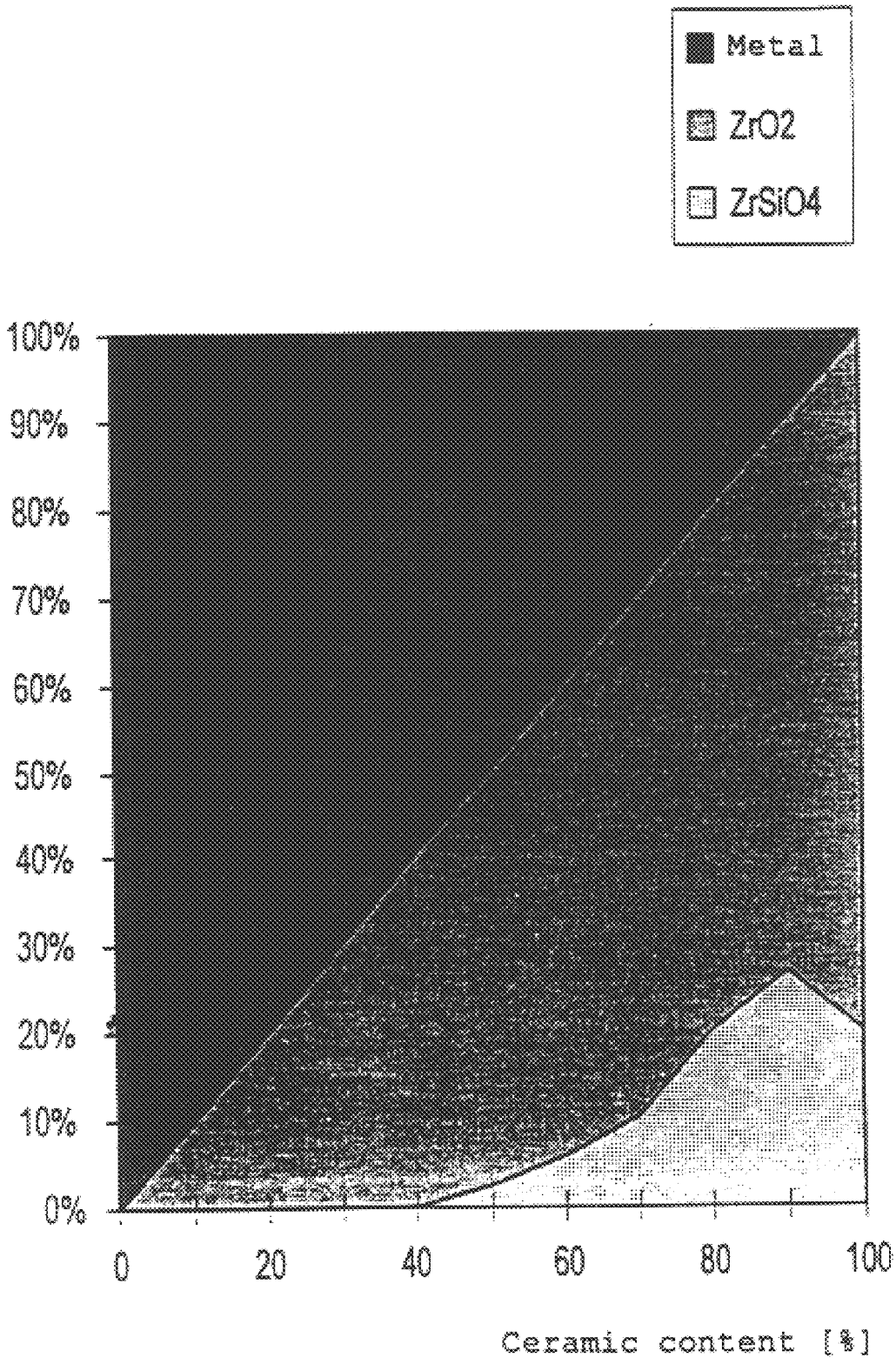
FIG. 1*b* is a photograph showing a composite, nonlinear gradient of the composition for a thermal barrier FGM material.

Metal-ceramic Functional Gradient Materials (referred to below as FGM) are produced by powder metallurgy. The material combinations investigated were 8Y—$ZrO_2$—NiCr8020-FGM, 8Y—$ZrO_2$—$ZrSiO_4$—NiCr8020-FGM, (as well as 8Y—$ZrO_2$—$ZrPO_4$—NiCr8020-FGM and, with the same ceramic composition, steel-, TiAl- and NiAl-intermetallic compounds, Mo and all material combinations with $Al_2O_3$ ceramic instead of $ZrO_2$). The FGM powder preforms are formed of 8Y—$ZrO_2$ powder (d50 0.3 $\mu$m, commercially available from the Tosoh company) and <25 $\mu$m NiCr8020 powder (Ampersint, commercially available from H.C. Starck GmbH, Germany) and $ZrSiO_4$ powder (commercially available, 99%). Using silicone moulds, cylindrical specimens with dimensions of ϕ35 mm×15 mm are formed by pouring in the dry state up to 12 individual mixtures, in which the percentage by volume of ceramic (including 20% of $ZrSiO_4$) increases from layer to layer. In the case of the metal-containing zones, the $ZrSiO_4$ is initially ground together with the metal powder in a planetary mill and then mixed with the appropriate quantity of 8Y—$ZrO_2$. The additives can be introduced not only in the form of powders but also by coating through the use of precursors or by infiltration of powder preforms with precursor compounds. FIG. 1*a* shows a linear gradient between the metal and $ZrO_2$. In FIG. 1*b*, the gradient between the metal component and the combined ceramic is also linear, but the proportion of the individual ceramic components ($ZrO_2$ and $ZrSiO_4$) changes in a non-linear manner. In a region where there is a low metal content, the $ZrSiO_4$ content reaches a high level, with a maximum, and as the amounts of metal increase it falls to zero, before the $ZrO_2$ content falls to zero. Other gradients, e.g. linear, exponential or periodic gradients, are also possible. The concentration gradient of the additive may be essentially continuous in the gradient material. It is also possible for the concentration gradient of the additive to extend from the ceramic-rich zone as far as into the metal-rich zone, for the concentration of the additive to have a maximum, in particular between the metal-rich zone and the ceramic-rich zone, for the concentration of the additive to increase from approximately 5% by volume in the metal-rich zone to approximately 30% by volume and in the ceramic-rich zone to fall to approximately 5% by volume and/or to have a plurality of maximums, and correspondingly a plurality of minimums as well. It is also possible for the concentration of the additive to change in a monotone manner from the ceramic-rich zone to the metal-rich zone. In this case, the grain size distribution of the additive may be bimodal, in particular having a fine-grain fraction with grain diameters of less than 10 μm and a coarse-grain fraction with grain diameters of greater than 100 μm. The additive can form pores, in particular with a diameter of between 0.1 μm and 5 μm, preferably between 1.0 μm and 2.0 μm, which reduce the thermal conductivity, impede resintering and increase resistance to thermal shocks.

The silicone moulds which have been filled with powder are evacuated and pressed isostatically at 300 MPa. The sintering is carried out at zero pressure through the use of microwaves, through the use of a combined conventional/microwave heating, or through the use of conventional heating in a resistance-heated furnace. The sintering gases which are used are Ar, Ar—$H_2$, $H_2$, $N_2$, He or combinations of these gases. The sintering takes place with or without a temperature gradient (e.g. $T(ZrO_2)>T(NiCr)$) depending on the material composition and sintering activity of the powders and mixtures being employed.

The hardness, the linear thermal expansion, the modulus of elasticity and the mechanical losses were determined with the aid of Vickers indentations, with a TMA and a DMA. The slow crack propagation was tested on notched 3 PB specimens (SENB). The microstructure is characterized through the use of SEM-EDX. The linear thermal expansion and the thermal conductivity of the 8Y—$ZrO_2$—$ZrSiO_4$NiCr8020-FGM were estimated through the use of limit value curves from tabulated data on the pure substances and from the microstructure features.

Oxidation tests up to 1160° C. of the ceramic side, with the metal side cooled only by radiation emission, were carried out in a tube furnace. Tests at 1200° C. on the ceramic side with an actively cooled metal side were carried out in a converted high-temperature furnace with kanthal heating elements. In these oxidation tests, the metal side was cooled to 500° C. by being blasted with compressed air. The temperature on the ceramic side was measured by using a thermocouple disposed at the side. The temperature in the furnace chamber was approximately 1340–1380° C.

Figure 2A:
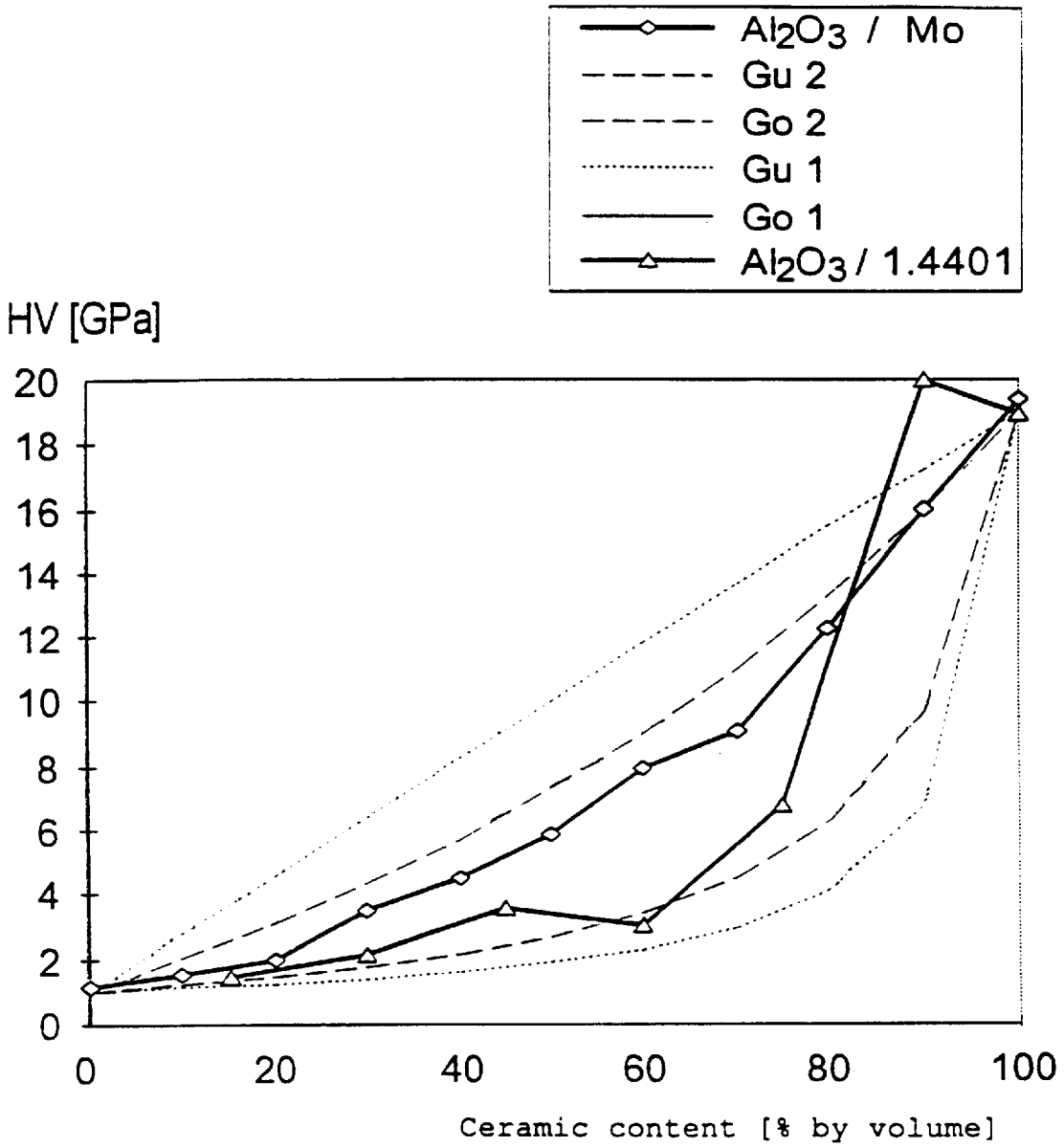
FIGS. 2*a* and 2*b* are graphs showing hardness curves of different metal-ceramic FGMs.
Figure 2B:
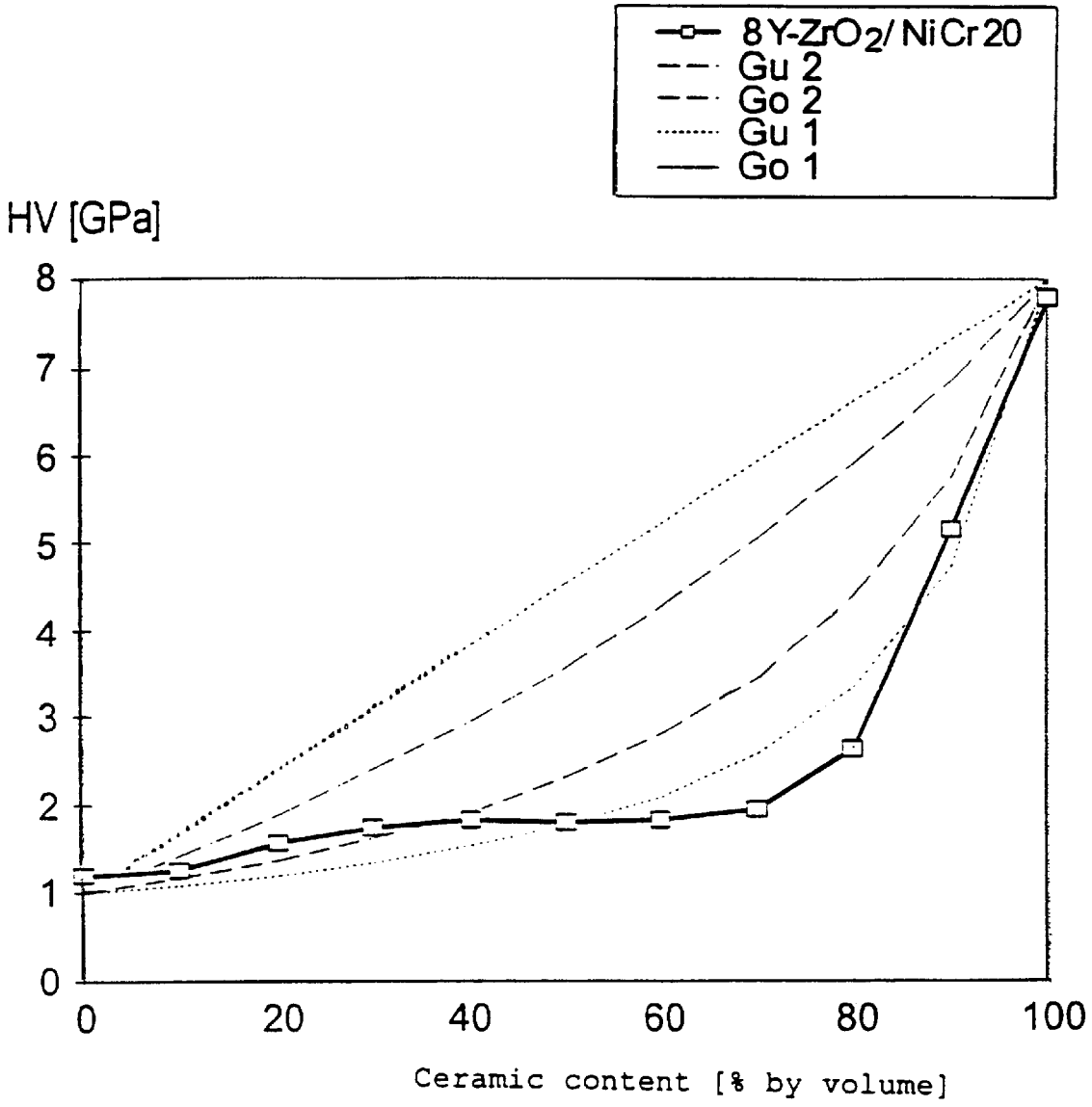
Figure 3:
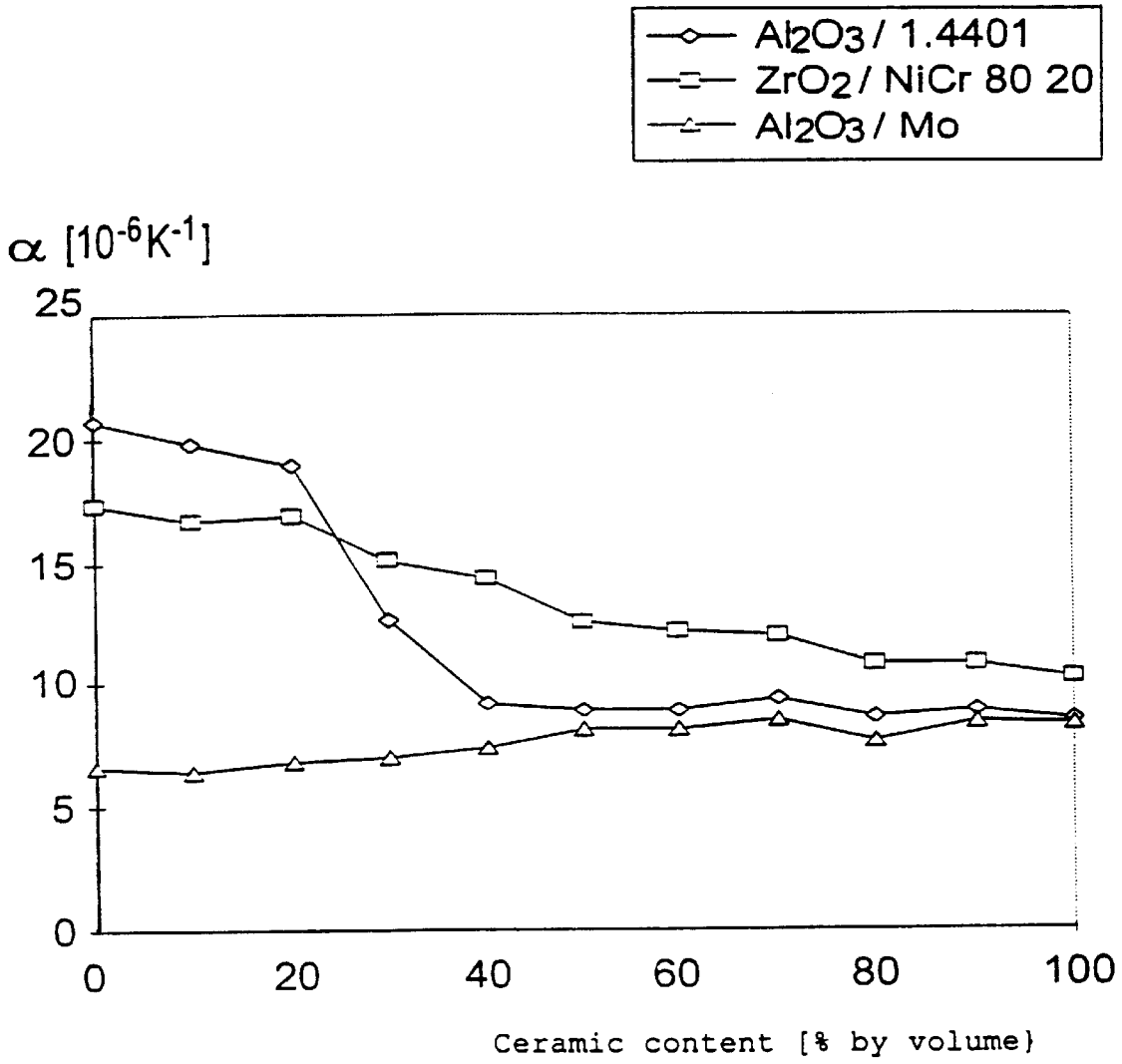
FIG. 3 is a graph showing a thermal expansion of different metal-ceramic FGMs.

FIGS. 2*a*, 2*b* and 3 show graphs presenting some data regarding the hardness and the thermal expansion of metal-ceramic FGM, e.g. with ceramic-metal of the type $Al_2O_3$-MO; $Al_2O_3$-steel (1.4401); 8Y—$ZrO_2$—NiCr8020. Limit value considerations result in a property profile shown in Table 1 for the thermal conductivity and thermal expansion of 8Y—$ZrO_2$—$ZrSiO_4$—NiCr8020-FGM. The thermal conductivity values can be reduced further, to <0.6 $Wm^{-1}K^{-1}$ by incorporating large grains and a defined network of cracks.

TABLE 1

Thermal conductivity and thermal expansion of 8Y—$ZrO_2$—$ZrSiO_4$—NiCr8020-FGM from a consideration of limit values (porosity maximally 30%)

| profile % ceramic | λ [$Wm^{-1}K^{-1}$] | α [$10^{-6}$ $K^{-1}$ Gu2 | α [$10^{-6}$ $K^{-1}$ Go2 | α [$10^{-6}$ $K^{-1}$ Gu1 | α [$10^{-6}$ $K^{-1}$ Go1 |
|---|---|---|---|---|---|
| 0 | 5.7 | 17.3 | 17.3 | 17.3 | 17.3 |
| 10 | 4.4 | 16.7 | 16.7 | 16.7 | 16.7 |
| 20 | 3.5 | 16.4 | 16.4 | 16.4 | 16.4 |
| 30 | 2.9 | 15.0 | 15.0 | 15.0 | 15.0 |
| 40 | 2.4 | 14.3 | 14.3 | 14.3 | 14.3 |
| 50 | 2.0 | 12.5 | 12.5 | 12.5 | 12.5 |
| 60 | 1.7 | 10.9 | 10.4 | 9.7 | 11.2 |
| 70 | 1.5 | 9.6 | 8.9 | 8.0 | 10.2 |
| 80 | 1.3 | 7.9 | 7.3 | 6.6 | 8.7 |
| 90 | 1.1 | 8.4 | 7.8 | 7.1 | 8.9 |
| 100 | 0.7 | 9.3 | 9.1 | 8.6 | 9.6 |

Figure 4A:
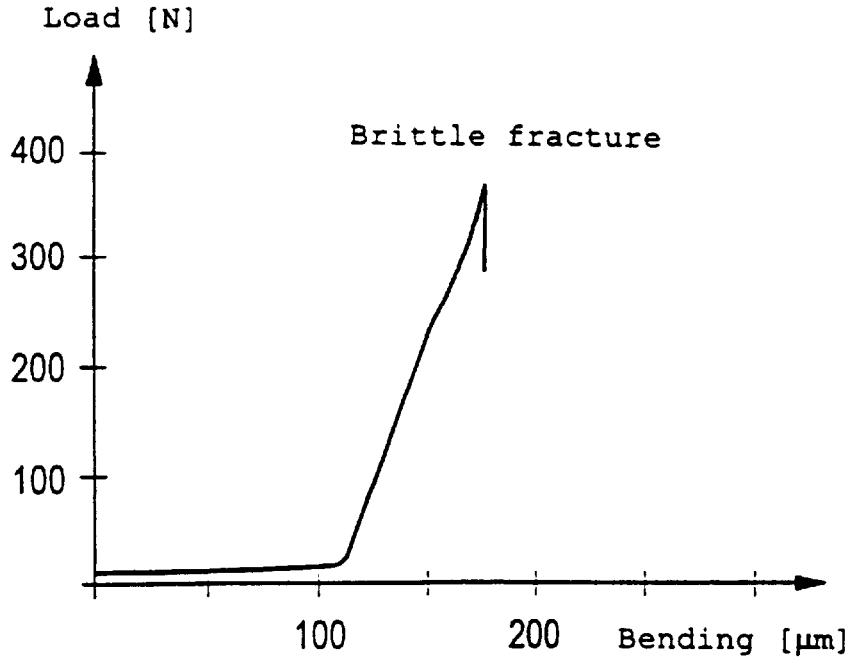
FIG. 4*a* is a graph showing a controlled crack propagation in 8Y—$ZrO_2$—$ZrSiO_4$—NiCr8020-FGM with incipient cracking in a ceramic zone (a/w<0.3)
Figure 4B:
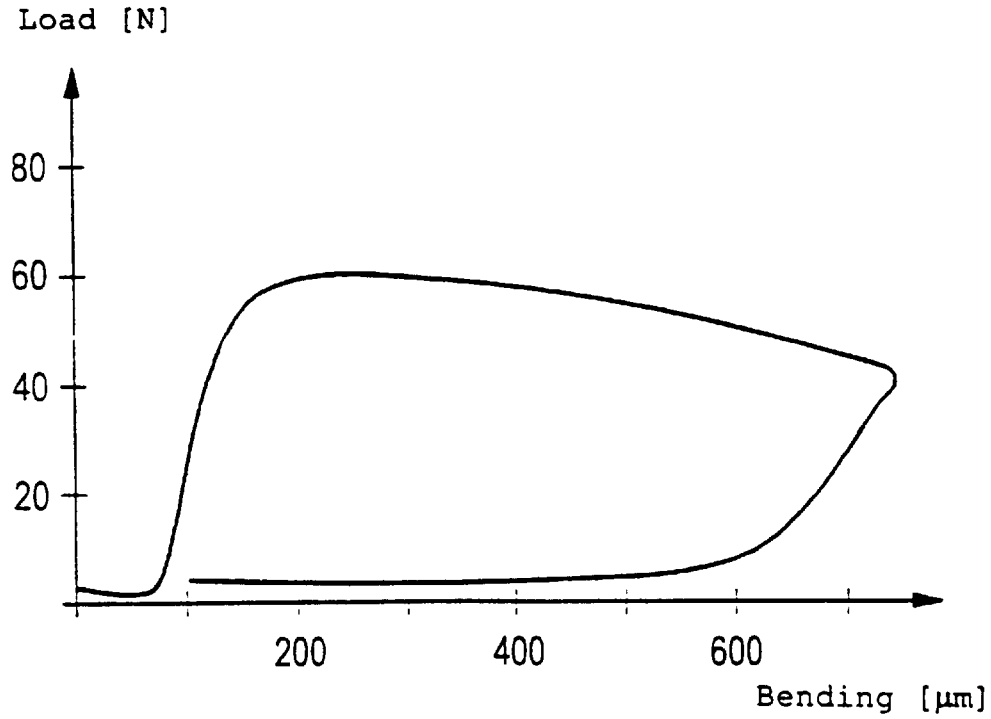
FIG. 4*b* is a graph showing a controlled crack propagation in 8Y—$ZrO_2$—$ZrSiO_4$—NiCr8020-FGM with incipient cracking in a metal-rich zone (a/w>0.5)

FIGS. 4*a* and 4*b* show results of testing of the controlled crack propagation. In accordance with FIG. 4*a*, a brittle fracture occurs at a bending of approximately 180 μm, although a load-bending characteristic line deviates considerably even after bending of approximately 120 μm.

The progress of the modulus of elasticity of $Al_2O_3$-steel-FGM is listed by way of example in Table 2.

TABLE 2

Modulus of elasticity as a function of the composition for $Al_2O_3$-steel-FGM

| $Al_2O_3$-content [%] | $E/E_{max}$ [Gpa] | E |
|---|---|---|
| 15 | 0.58 | 197.2 |
| 30 | 0.53 | 180.2 |
| 45 | 0.71 | 241.4 |
| 60 | 0.49 | 166.6 |
| 75 | 0.64 | 217.6 |
| 90 | 0.75 | 255 |
| 100 | 1.00 | 340 |

Figure 5:
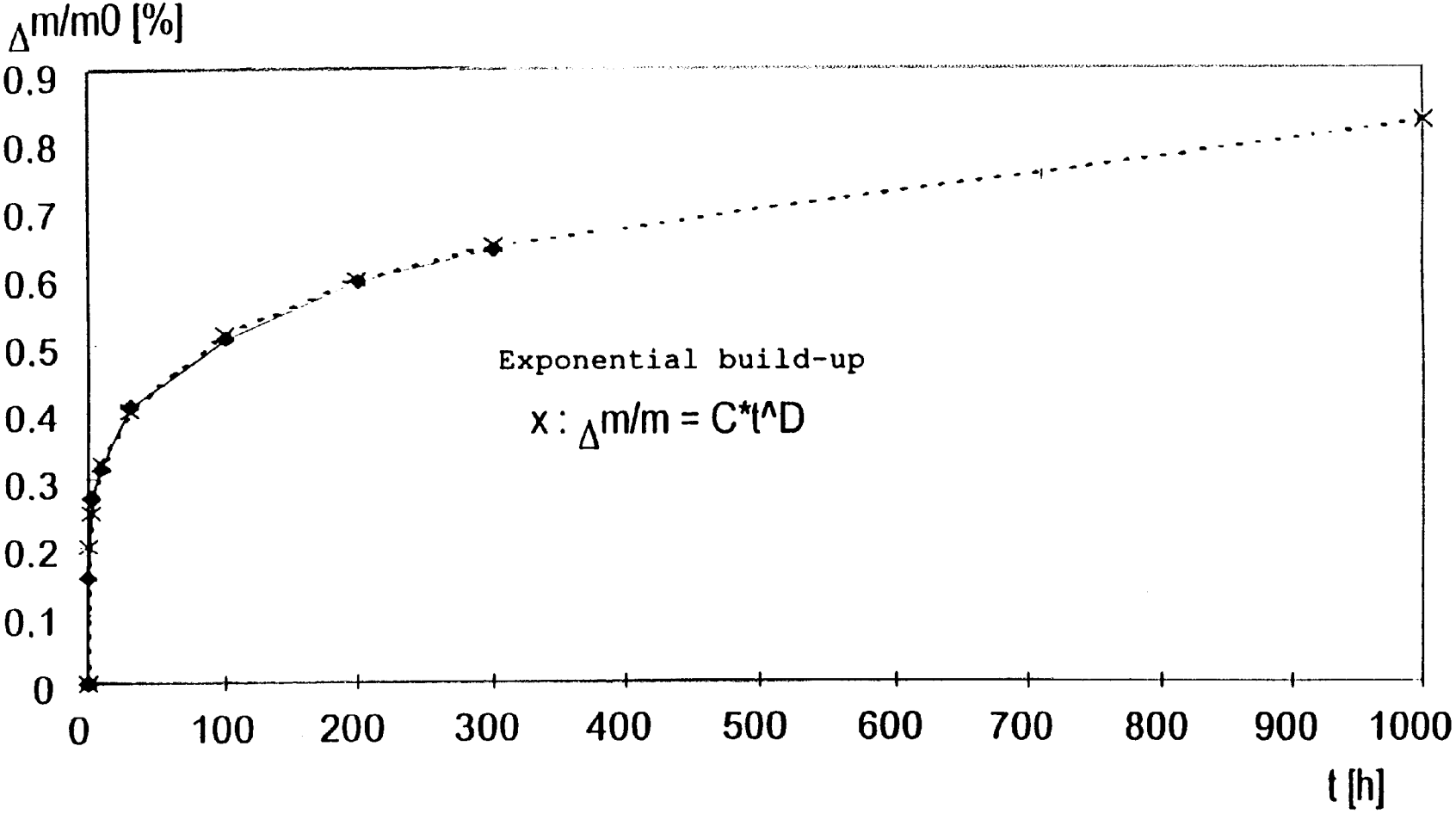
FIG. 5 is a graph showing an oxidation of 8Y—$ZrO_2$—$ZrSiO_4$—NiCr8020-FGM at 1200° C. with a gradient in accordance with FIG. 1*b;*
Figure 6:
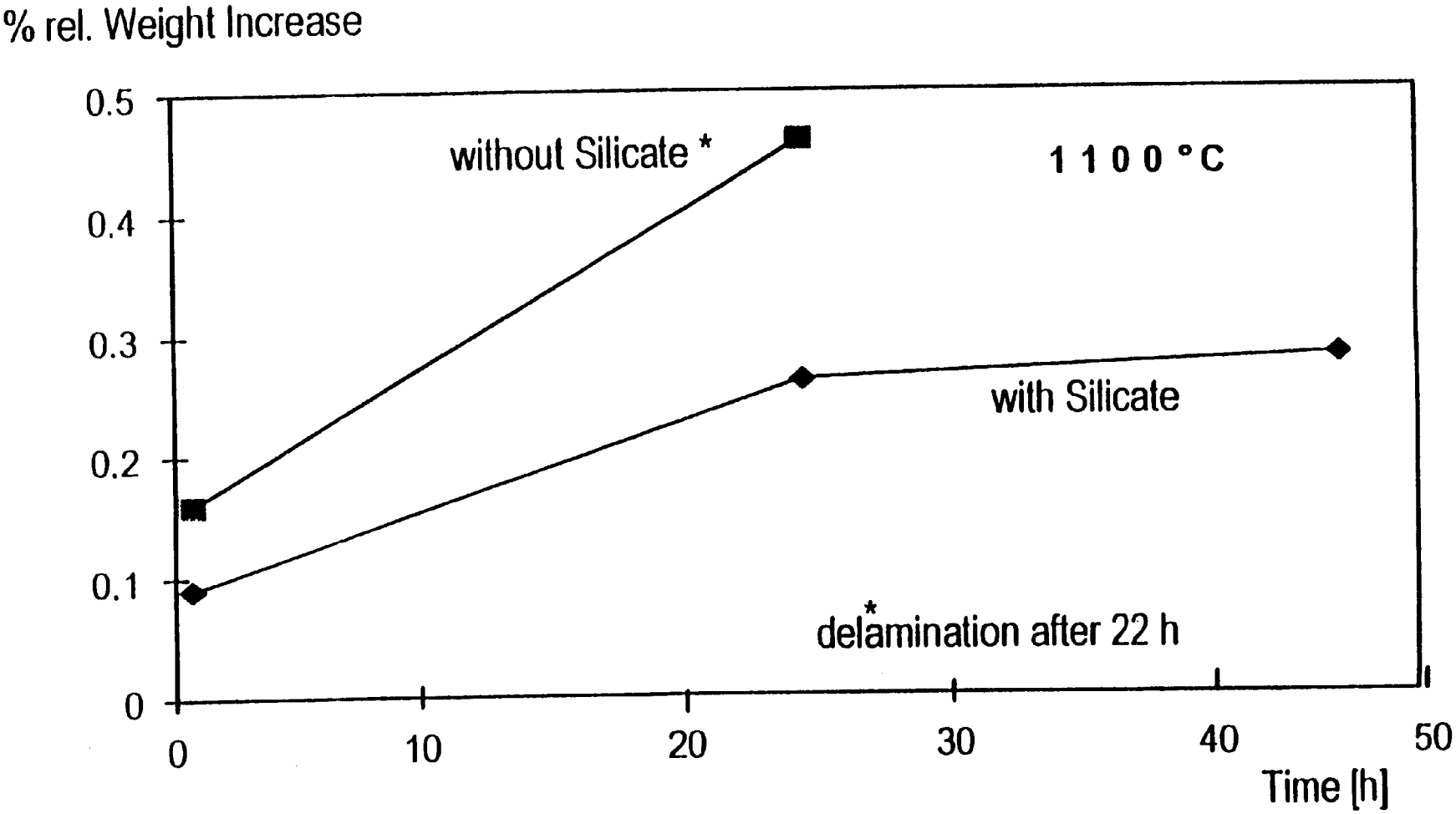
FIG. 6 is a graph showing a comparison of an oxidation resistance of linear 8Y—$ZrO_2$—NiCr8020-FGM and linear 8Y—$ZrO_2$—$ZrSiO_4$—NiCr8020-FGM.

The addition of $ZrSiO_4$ with the concentration curve shown in FIG. 1*b* leads to a considerable increase in the oxidation resistance in comparison with a $ZrSiO_4$ gradient which is localized not before the metal-ceramic zone of the FGM, as can be seen from a comparison between FIG. 5 and FIG. 6. These figures each show the percentage loss of mass over time. In accordance with FIG. 6, at a temperature of approximately 1100° C. the mass loss is reduced significantly by the addition of silicate. With the linear gradient, a better oxidation resistance than with the $ZrSiO_4$-free material can be observed at temperatures of up to 1100° C. With a nonlinear $ZrSiO_4$ gradient, there is additionally a long-term oxidation resistance at 1200° C.

Figure 7A:
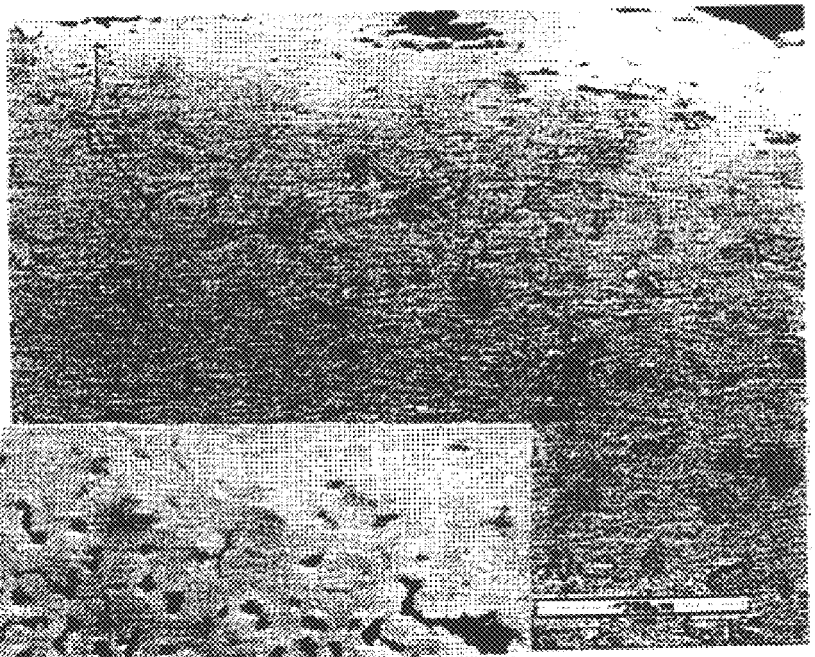
FIGS. 7*a* and 7*b* are photographs respectively showing an overview and a grain structure of a ceramic layer of an oxidation-resistant gradient material after thermal etching at 1450° C. under air for 0.5 h.
Figure 7B:
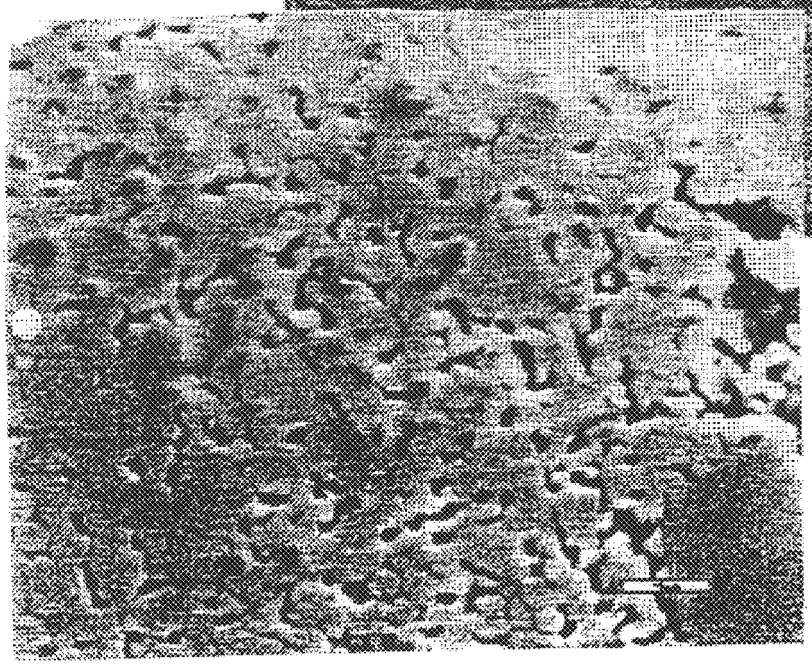

At 1200° C., the FGM undergoes slight resintering. As is shown in FIGS. 7*a* and 7*b* (thermally etched) and FIGS. 8*a* and 8*b* (after 300 h/1200° C.), this results in an increase in the opening of cracks in the isotropic network of cracks which results from the large $ZrSiO_4$ grains. The 8Y—$ZrO_2$ agglomerates exhibit compaction and grain growth, from <2 μm to approximately 5 μm. Despite this grain growth, the ceramic zones of the FGM are extremely fine-grained in comparison with sprayed Thermal Bond Coats (TBC).

Figure 9:
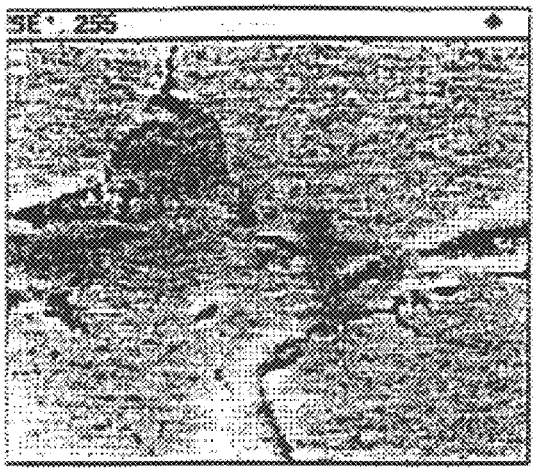
FIG. 9 is a group of photographs showing $ZrSiO_4$ bridges between $ZrO_2$ grains.
Figure 9:
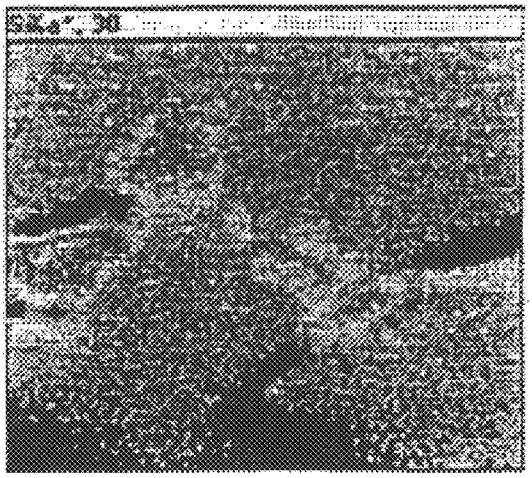
Figure 9:
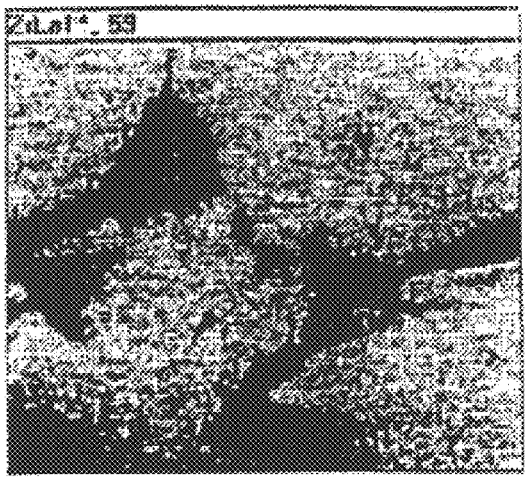
Figure 10:
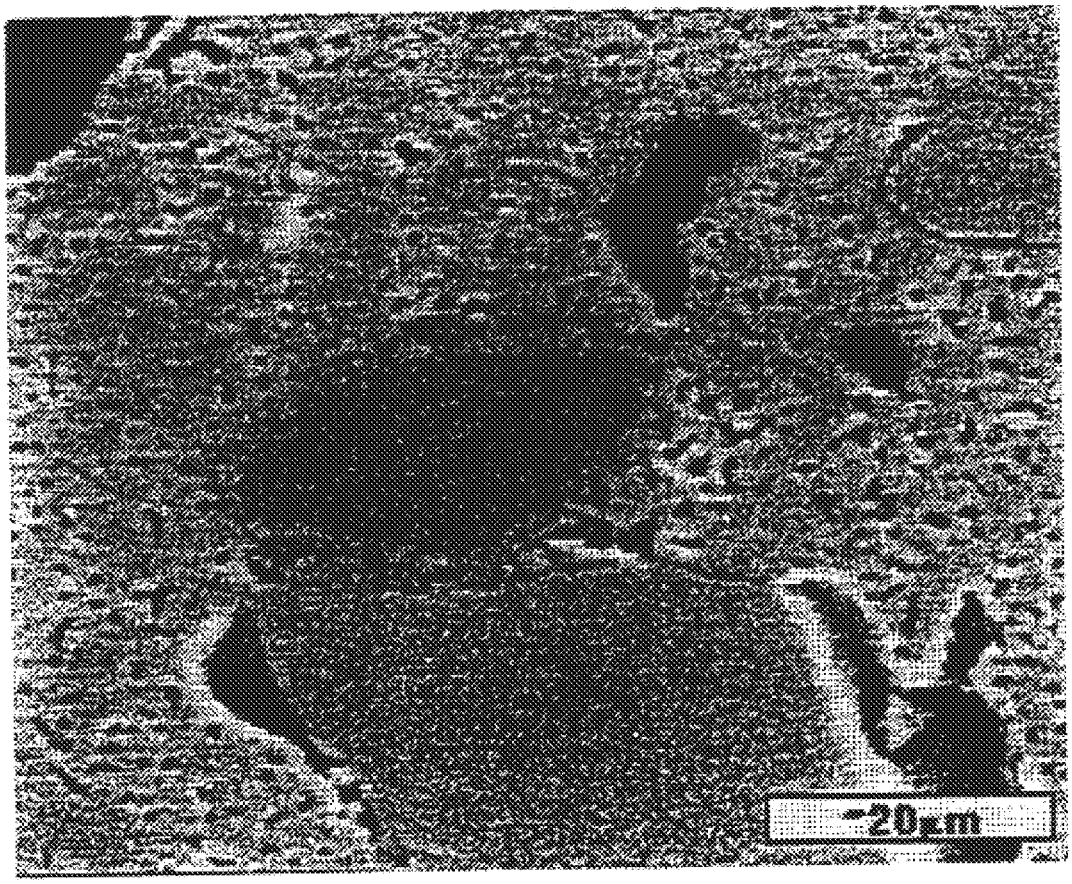
FIG. 10 is a photograph showing $ZrSiO_4$-metal bridges, after oxidation.

The mechanical strength of the FGM is supported by small $ZrSiO_4$ bridging grains, as is shown in FIG. 9. These bridges are not degraded by oxidation and can be found both between ceramic grains as well as on metal grains, as is shown in FIG. 10. The large $ZrSiO_4$ grains (50–100 μm) cause a network-like propagation of the shrinkage cracks, with the result that the sintered-together 8Y—$ZrO_2$ agglomerates retain good interlocking.

After 300 h oxidation and repeated cooling (for the purpose of determining weight), the round FGM test specimen (ϕ approximately 25 mm) shows only a few cracks which run vertically into the metal-rich zones. There is no evidence of these cracks deviating, which would lead to delamination.

Figure 11:
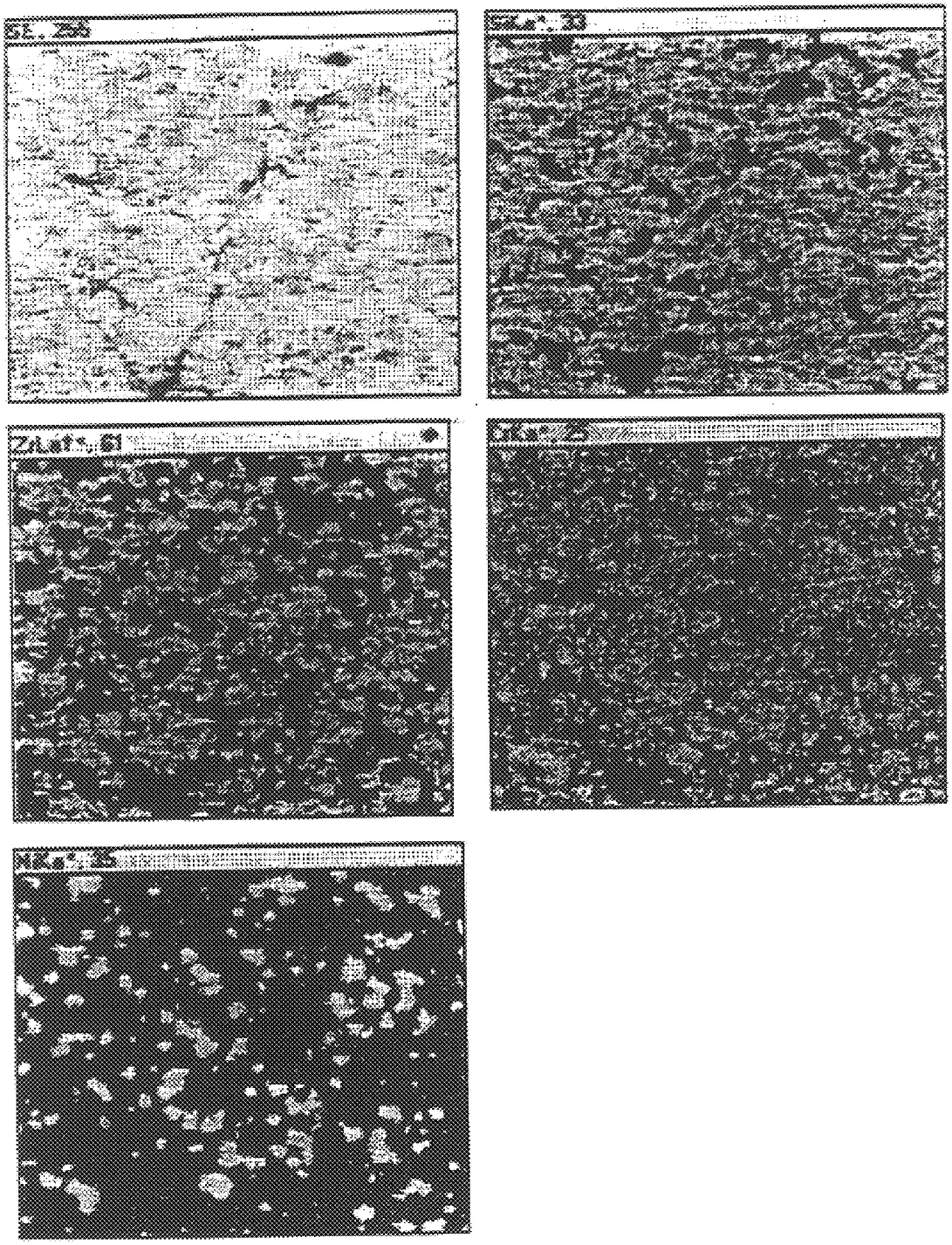
FIG. 11 is a group of photographs showing a macroscopic crack which runs from the bottom upwards (top photograph) and is stopped in the metal-rich zone of the FGM (EDX)
Figure 12:
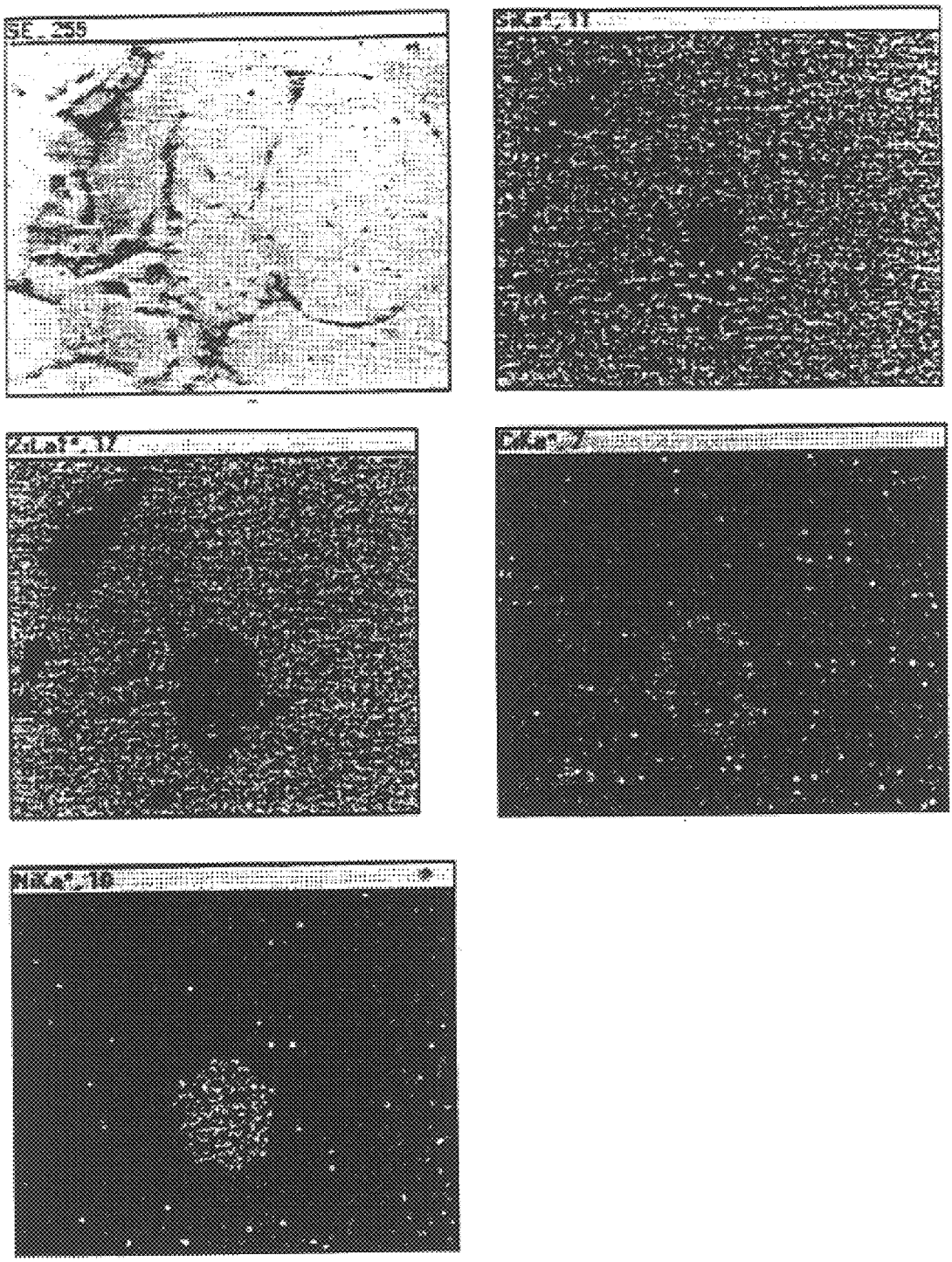
FIG. 12 is a group of photographs showing a dissolution of a Cr oxide, produced by oxidation, in a silicate, EDX.

Additionally, there are no break-outs from the ceramic zone. The cracks are stopped by metal grains, as can be seen in FIG. 11. The oxidation of individual metal grains which these cracks allow leads to the partial formation of Cr oxide. As is shown in FIG. 12, the Cr oxide is dissolved by silicate ($ZrSiO_4$). At the same time, the silicate covers the metal grain and protects it from further attack from oxidation.

The $ZrSiO_4$ acts as an oxidation inhibitor, whereby segregation of $SiO_2$ at the grain boundaries of tightly sintered 8Y—$ZrSiO_4$ significantly reduces the conductivity of the $ZrO_2$ with regard to oxygen ions. Crystalline $ZrSiO_4$ ought to have a similar effect. The thermal expansion of the $ZrSiO_4$ is significantly is less than that of 8Y—$ZrO_2$ ($4.5\cdot10^{-6}$ $Wm^{-1}K^{-1}$ compared to $8–10\cdot10^{-6}$ $Wm^{-1}K^{-1}$) and of NiCr8020. As a result, a network of fine cracks is formed during cooling from the sintering temperature. Although these cracks could allow oxygen to enter the metal-containing zones of the FGM as well, the adhesion between metal and $ZrSiO_4$ and 8Y—$ZrO_2$ and $ZrSiO_4$ is better than that between metal and oxide, so that the cracks run in the $ZrSiO_4$ and therefore there is no direct contact between the metal and the oxygen-containing atmosphere. $ZrSiO_4$ exhibits good solubility with regard to other oxides and is thermodynamically stable at up to 1650° C. Thus any oxidation products would be able to obtain improved adhesion to the metal and protect the metal against further attack from oxidation. In the presence of excess $ZrO_2$, dissociated $ZrSiO_4$ should reassociate even at 1200° C. to form crystalline $ZrSiO_4$. Therefore, the formation of pores as a result of evaporation of SiO or other volatile oxides can be suppressed.

The network of cracks ought to significantly reduce the thermal conductivity and the modulus of elasticity of the ceramic-rich zones of the FGM, leading to improved resistance to temperature changes (RTC). The nature of the introduction of the $ZrSiO_4$ is therefore important for the fineness of the $ZrSiO_4$ distribution and the resulting network of cracks.

In this case it is necessary to take into account that $ZrSiO_4$ may not be stable under the plasma spraying conditions and, depending on cooling conditions, may dissociate into t-$ZrO_2$ and $SiO_2$ glass. Frequently, SiO is released in the process. The dissociation takes place at above 1650° C. Reassociation takes place within a few hours at temperatures of between 1200–1400° C. The reformation of the $ZrSiO_4$ is accelerated by $ZrO_2$ and by grinding up the PDZ (Plasma Dissociated Zircon).

Under certain circumstances, considerable crack formation occurs during the reassociation. $ZrSiO_4$ can be obtained as a single-phase ceramic by sintering at 1700° C. in air. A powder metallurgy production route is therefore advantageous for 8Y—$ZrO_2$—$ZrSiO_4$—NiCr8020-FGM. An even distribution of $SiO_2$ is then present throughout the entire FGM as a result, inter alia, of dissociation-reassociation of the silicate.

Figure 8A:
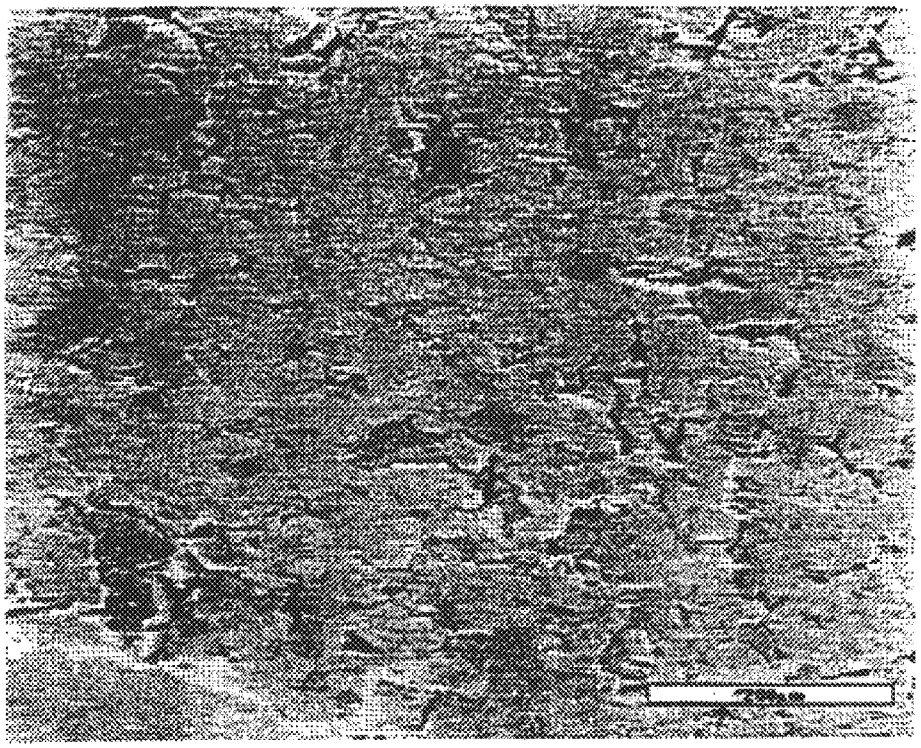
FIGS. 8*a* and 8*b* are photographs respectively showing an overview and a grain structure of a ceramic layer of an oxidation-resistant gradient material after oxidation for 300 h at 1200° C. under air.
Figure 8B:
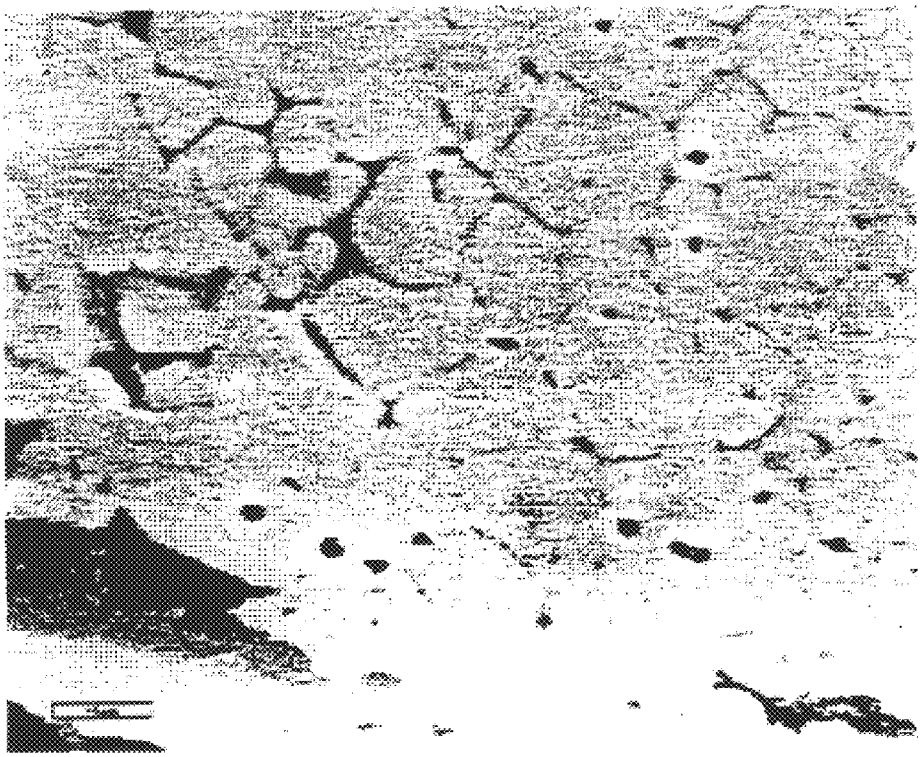

The time and the oxygen-containing atmosphere are also partly responsible for the resintering. FIGS. 7*a* and 8*a* show an FGM specimen of the same composition and microstructure as the specimens used with regard to oxidation, but this specimen has been thermally etched in order to reveal the grain boundaries in the ceramic region, specifically in air at 1459° C./0.5 h. When compared to the unetched specimen, the result is a comparable porosity and agglomerate structure as well as grain size (approximately 2 μm). Due to the sintering of the FGMs under an Ar/$H_2$ atmosphere, the $ZrO_2$ that is obtained is not optimally compressed, since the oxygen is missing from the sintering atmosphere.

The effect of $ZrSiO_4$ or comparable additives, such as phosphates, etc., is not limited to a gradient material of the type 8Y—$ZrO_2$—NiCr8020. $ZrSiO_4$ can also be used as oxidation protection against the active oxidation of porous SiC, as well as in the 8Y—$ZrO_2$—NiCr8020-FGMs. The SiC—$ZrO_2$ composite material is preferably sintered at zero pressure, forming a sufficiently thick $ZrSiO_4$ layer around the SiC grains. The sintering is likewise carried out through the use of microwaves. Due to the porosity of the bodies, in this case the weight changes (increase and decrease) are related to the specific surface area. In this case, no increase of the specific surface area, which ought to occur in the event of a competition reaction between passive and active oxidation, was observed.

We claim:

1. A metal-ceramic gradient material, comprising:

a metal base material;

a ceramic material;

a metal-rich zone;

a ceramic-rich zone;

an additive for high-temperature oxidation protection;

said metal base material having a concentration decreasing from said metal-rich zone into said ceramic-rich zone;

said additive having a concentration with a concentration gradient; and said concentration of said additive having a maximum in a direction from said metal-rich zone into said ceramic-rich zone.

2. The gradient material according to claim 1, wherein said concentration gradient of said additive is essentially continuous.

3. The gradient material according to claim 1, wherein said concentration gradient of said additive extends from said ceramic-rich zone as far as into said metal-rich zone.

4. The gradient material according to claim 1, including a metal-free zone, said maximum lying between said metal-free zone and said ceramic-rich zone.

5. The gradient material according to claim 4, wherein said concentration of said additive increases from approximately 5% by volume in said metal-rich zone to approximately 30% by volume and falls to approximately 5% by volume in said ceramic-rich zone.

6. The gradient material according to claim 4, wherein said concentration of said additive has a plurality of maximums.

7. The gradient material according to claim 5, wherein said concentration of said additive has a plurality of maximums.

8. The gradient material according to claim 1, wherein said additive has a bimodal grain size distribution.

9. The gradient material according to claim 1, wherein said additive has a fine-grain fraction with grain diameters of less than 10 $\mu$m and a coarse-grain fraction with grain diameters of greater than 100 $\mu$m.

10. The gradient material according to claim 1, wherein said additive forms pores.

11. The gradient material according to claim 1, wherein said pores have a diameter of between 0.1 $\mu$m and 5 $\mu$m.

12. The gradient material according to claim 1, wherein said pores have a diameter of between 1.0 $\mu$m and 2.0 $\mu$m.

13. The gradient material according to claim 1, wherein said metal base material is a nickel-chromium alloy and said ceramic material includes zirconium oxide.

14. The gradient material according to claim 1, wherein said additive includes zirconium silicate.

15. A product, comprising a gradient material including:
- a metal base material;
- a ceramic material;
- a metal-rich zone;
- a ceramic-rich zone;
- an additive for high-temperature oxidation protection;
- said metal base material having a concentration decreasing from said metal-rich zone into said ceramic-rich zone;
- said having a concentration with a concentration gradient; and
- said additive concentration of said additive having a maximum in a direction from said metal-rich zone into said ceramic-rich zone.

16. A gas turbine blade, comprising:

a gradient material including;
- a metal base material;
- a ceramic material;
- a metal-rich zone;
- a ceramic-rich zone
- an additive for high-temperature oxidation protection;
- said metal base material having a concentration decreasing from said metal-rich zone into said ceramic-rich zone;
- said additive having a concentration with a concentration gradient; and
- said concentration of said additive having a maximum in a direction from said metal-rich zone into said ceramic-rich zone.

17. A heat-protection element of a gas turbine, comprising:

a gradient material including:
- a metal base material;
- a ceramic material;
- a metal-rich zone;
- a ceramic-rich zone;
- an additive for high-temperature oxidation protection;
- said metal base material having a concentration decreasing from said metal-rich zone into said ceramic-rich zone;
- said additive having a concentration with a concentration gradient; and
- said concentration of said additive having a maximum in a direction from said metal-rich zone into said ceramic-rich zone.

18. A process for producing a gradient material, which comprises:

pouring powders having different mixtures of at least one of a metal base material, a ceramic material and an additive for high-temperature oxidation protection over one another to form a packed bed; and then compacting and sintering the packed bed to form a gradient material;

the metal base material having a concentration decreasing from a metal-rich zone into a ceramic-rich zone, the additive having a concentration with a concentration gradient, and the concentration of the additive having a maximum in a direction from the metal-rich zone into the ceramic-rich zone.

* * * * *